US005860230A

United States Patent [19]

Daniels

[11] Patent Number: 5,860,230

[45] Date of Patent: Jan. 19, 1999

[54] SNOWPLOW WITH BLADE END SNOW DEFLECTORS

[75] Inventor: Gregory J. Daniels, East Dundee, Ill.

[73] Assignee: Daniels Pull Plow, Inc., East Dundee, Ill.

[21] Appl. No.: 910,022

[22] Filed: Aug. 12, 1997

Related U.S. Application Data

[63] Continuation-in-part of Ser. No. 485,464, Jun. 7, 1995, Pat. No. 5,655,318.

[51] Int. Cl.[6] ..... E01H 5/04

[52] U.S. Cl. ..... 37/232; 37/231; 37/281; 172/816; 172/817

[58] Field of Search ..... 37/231, 232, 233, 37/264, 266, 267, 281, 274; 172/810, 811, 816, 817, 828

[56] References Cited

U.S. PATENT DOCUMENTS

| | | | |
|---|---|---|---|
| Re. 31,045 | 10/1982 | Essell et al. | 37/281 |
| 1,389,118 | 8/1921 | Bergeron | 37/274 |
| 2,999,697 | 9/1961 | Winget | 37/266 |
| 3,279,104 | 10/1966 | Wandscheer et al. | 37/280 |
| 3,418,734 | 12/1968 | McConnell . | |
| 3,605,167 | 9/1971 | Martel et al. . | |
| 3,720,010 | 3/1973 | Coates . | |
| 3,803,733 | 4/1974 | Ramsey | 37/273 |
| 3,898,753 | 8/1975 | Kinnunen . | |
| 4,019,268 | 4/1977 | Waterman . | |
| 4,074,448 | 2/1978 | Niemela . | |
| 4,096,652 | 6/1978 | Raines et al. . | |
| 4,099,578 | 7/1978 | Stevens . | |
| 4,135,583 | 1/1979 | Becker . | |
| 4,159,584 | 7/1979 | Niemela | 37/273 |
| 4,243,356 | 1/1981 | Takojima . | |
| 4,249,323 | 2/1981 | Mathis et al. . | |
| 4,275,514 | 6/1981 | Maura . | |
| 4,306,362 | 12/1981 | Waterman . | |
| 4,356,645 | 11/1982 | Hine et al. . | |
| 4,372,617 | 2/1983 | Zamboni . | |
| 4,403,432 | 9/1983 | Biance . | |
| 4,439,939 | 4/1984 | Blau . | |
| 4,479,312 | 10/1984 | Turgeon . | |
| 4,707,936 | 11/1987 | Steinhoff . | |
| 4,723,609 | 2/1988 | Curtis . | |
| 4,741,116 | 5/1988 | Engle et al. . | |
| 4,907,357 | 3/1990 | Lilienthal . | |
| 4,962,600 | 10/1990 | Zellaha et al. . | |
| 5,046,271 | 9/1991 | Daniels . | |
| 5,058,295 | 10/1991 | Holland . | |
| 5,241,763 | 9/1993 | Dynan . | |
| 5,265,355 | 11/1993 | Daniels . | |
| 5,285,588 | 2/1994 | Niemela et al. . | |
| 5,431,528 | 7/1995 | Jenkins et al. . | |
| 5,636,458 | 6/1997 | Drake | 37/270 |
| 5,655,318 | 8/1997 | Daniels | 37/231 |
| 5,758,728 | 6/1998 | Ragule | 172/815 |

FOREIGN PATENT DOCUMENTS

| | | |
|---|---|---|
| 2710320 | 9/1978 | Germany . |

OTHER PUBLICATIONS

Hine et al, *Hydra–Scoop Snow Plow,* Farm Industry News, vol. 23, No. 7, p. 25 (Jul./Aug. 1990).

*Primary Examiner*—Michael J. Carone
*Assistant Examiner*—Victor Batson
*Attorney, Agent, or Firm*—Olson & Hierl, Ltd.

[57] ABSTRACT

A snowplow blade assembly is provided wherein the plow blade is provided at its opposite ends with snow deflectors. Preferably the snowplow blade assembly is also provided at its opposite ends with pivotable end extensions to which the snow deflectors are attached. Preferably each end extension is pivotable through an angle greater than about 175° from a fully extended and retained blade end extending configuration to a fully folded and retained blade length reducing and extension storage configuration. Each snow deflector comprises a base, a deflector plate that is pivotable relative to the base, a biasing member, an anchor for fastening the springs to the base, and arm members for connecting the springs with the deflector plate so that the deflector plate is biased into an open but deflectable configuration relative to the base. The snow deflector components are arranged and configured to move snow without becoming snow bound.

9 Claims, 7 Drawing Sheets

SNOWPLOW WITH BLADE END SNOW DEFLECTORS

RELATED APPLICATION

This application is a continuation-in-part of my earlier filed U.S. patent application Ser. No. 08/485,464 filed Jun. 7, 1995 now U.S. Pat. No. 5,655,318 issued Aug. 12, 1997, the disclosure and contents of which are fully incorporated in the present patent application by reference.

FIELD OF THE INVENTION

This invention relates to snowplows having blades that are provided at opposite end portions with snow deflector assemblies. The snow deflector assemblies are preferably associated with blades having blade end extensions.

BACKGROUND OF THE INVENTION

The width of the blade of a snowplow can raise problems particularly in the handling, transport and storage of the snowplow. For example, variations in roadway width can be troublesome since a blade that extends beyond the edge of a roadway can damage or even shear off shrubbery and other objects. Moreover, a wide blade may not be within legal width limits for road travel.

Snowplow blade end extensions have been proposed; see, for example, Maura U.S. Pat. No. 4,275,514 which discloses telescoping snowplow blade extensions, and Hine et al. U.S. Pat. No. 4,356,645 disclosing hydraulically controlled pivotably and incrementally positionable snowplow blade extensions.

However, such prior art extendable blade assemblies have a number of disadvantages. Thus, the Maura blade and extension assembly not only appears to be structurally weak, but also appears to be sensitive to certain use conditions (such as the possibility of ice formation between telescopically retracted and adjacent surface portions or in channels).

The Hine et al. blade assembly not only appears to be incapable of blade end extension pivoting beyond a limited acute angle, but also appears to require the use of only small moldboard blade curvature angles (since with relatively large moldboard blade curvature angles significant gaps develop between adjacent end portions as the pivot angle increases between the blade end and the adjacent extension end).

So far as now known, a simple, reliable and economical assembly of snowplow blade, equipped with blade end snow deflectors with the snow deflectors optionally but preferably being associated with blade end extensions, has not previously existed so far as shown. Preferably, each of the blade end extensions, as equipped with snow deflectors, can be either in an extended and locked blade extended position, or in a fully retracted and locked extension storage position. The present invention provides such assemblies.

SUMMARY OF THE INVENTION

More particularly, this invention provides a snowplow having a plow blade which is provided on the forward surface thereof adjacent at least one of its opposite ends with a snow deflector assembly.

Preferably, the plow blade length is adjustable. Thus, the blade is preferably associated at each of its opposite ends with a preferably pivotably movable blade end extension. The blade end extensions are each pivotable from a fully extended and blade lengthening end position to a folded blade length reducing and extension storage position. The latter position is achieved by pivoting each end extension from the blade extended position about a vertical axis located adjacent each opposed blade end through an angle in excess of about 175°. Latching means for each end extension storage position are preferably provided.

The invention avoids the need for powered blade snow deflector assemblies or for powered blade end extension maneuvering means for positioning of snow deflector assemblies and of blade end extensions.

The invention also provides a simple, reliable, operator-safe, manually operated, blade end associated, snow deflector assembly. Such an assembly can be either associated with a blade end or with a blade end extension, as chosen. Manual weight lifting and/or supporting operations by a snowplow operator of the snow deflector or of the heavy blade and/or the blade end extensions are completely avoided. Also, the problem of snow deflector-equipped blade end extension storage during non-use is avoided.

Details on pivotable blade end extensions, have previously been provided in U.S. Pat. No. 5,055,318 which achieves a hinge assembly for a blade end extension. The hinge assembly operably cooperates with the blade and with each of the associated opposed blade end extensions. Thus, each of the opposite blade end-associated blade end extensions is continuously pivotable from a fully blade aligned blade end extension position relative to each respective associated blade end to a full storage position where the back side of each end extension is located in an adjacent spaced, optionally substantially parallel, relationship relative to each end-adjacent portion of the back side of the associated blade. The assembly is preferably provided with simple, reliable, trouble-free latching means for use at each of the two intended terminal rest positions for each pivotable end extension. The assembly of snowplow blade and associated pivotable end extensions can be associated with various snowplow connection means. Preferably, however, the assembly is provided with a snowplow connection means which is adapted for connection or disconnection with a support and positioning subassembly that is associated with and located forwardly of a suitable vehicle, such as an earth moving machine, tractor, snow grooming vehicle or the like.

To augment the snow removal and collection capacity of a snowplow structure such as provided in my above indicated patent, a snowplow deflector in accord with my present disclosure is provided. When using a snow deflector in accord with my present invention with a snowplow, the snowplow vehicle connection means is preferably associated with the mid-back region of the blade and the snowplow is preferably tiltable from side to side about a vertical axis. The connection means does not interfere with the pivotable movements of the snow deflectors or of the optional blade end extensions. The connection means is preferably rapidly associatable with or dissociatable from the vehicularly associated support and positioning means in a simple and reliable manner without any need for manual lifting or supporting operations by an operator. Optionally but preferably, the connector means can incorporate a blade vertical tilt axis and hydraulic means for regulating blade assembly tilt angle relative to this axis. Also optionally but preferably, the connector means can incorporate a shock release arrangement involving blade tilting about a horizontal axis for preventing blade damage should a ground adjacent object be struck by an advancing blade assembly.

The vehicular associated support and positioning assembly is preferably associated with a forwardly extending, hydraulically adjustable mount frame that is operated through controls available to the vehicle operator. More preferably, the snowplow connection means is connectable with and disconnectable from the mount frame mainly by movements of the vehicle and of the mount frame without any snowplow manual lifting and/or supporting operations by an operator of the vehicle. Advantageously, the support and positioning means can be conventional and standardized in type and construction, thereby avoiding any need for a specially designed support and positioning means for use with the snowplow of this invention.

The inventive snowplow assembly equipped with snow deflector means is relatively simple, versatile, reliable, rugged and economical. The end extension pivoting is preferably carried out with the assembly preferably somewhat elevated above ground level with only manual guidance and without any requirement for fluidic (i.e, hydraulic) cylinders or the like.

Latching of each blade end extension when equipped with snow deflector means relative to the associated blade in each of the blade extension extended position and storage position is preferably achieved by mere pin insertion.

Other and further objects, aims, purposes, features, advantages, embodiments, applications and the like will be apparent to those skilled in the art from the present specification, accompanying drawings and appended claims.

DETAILED DESCRIPTION

Figure 1:
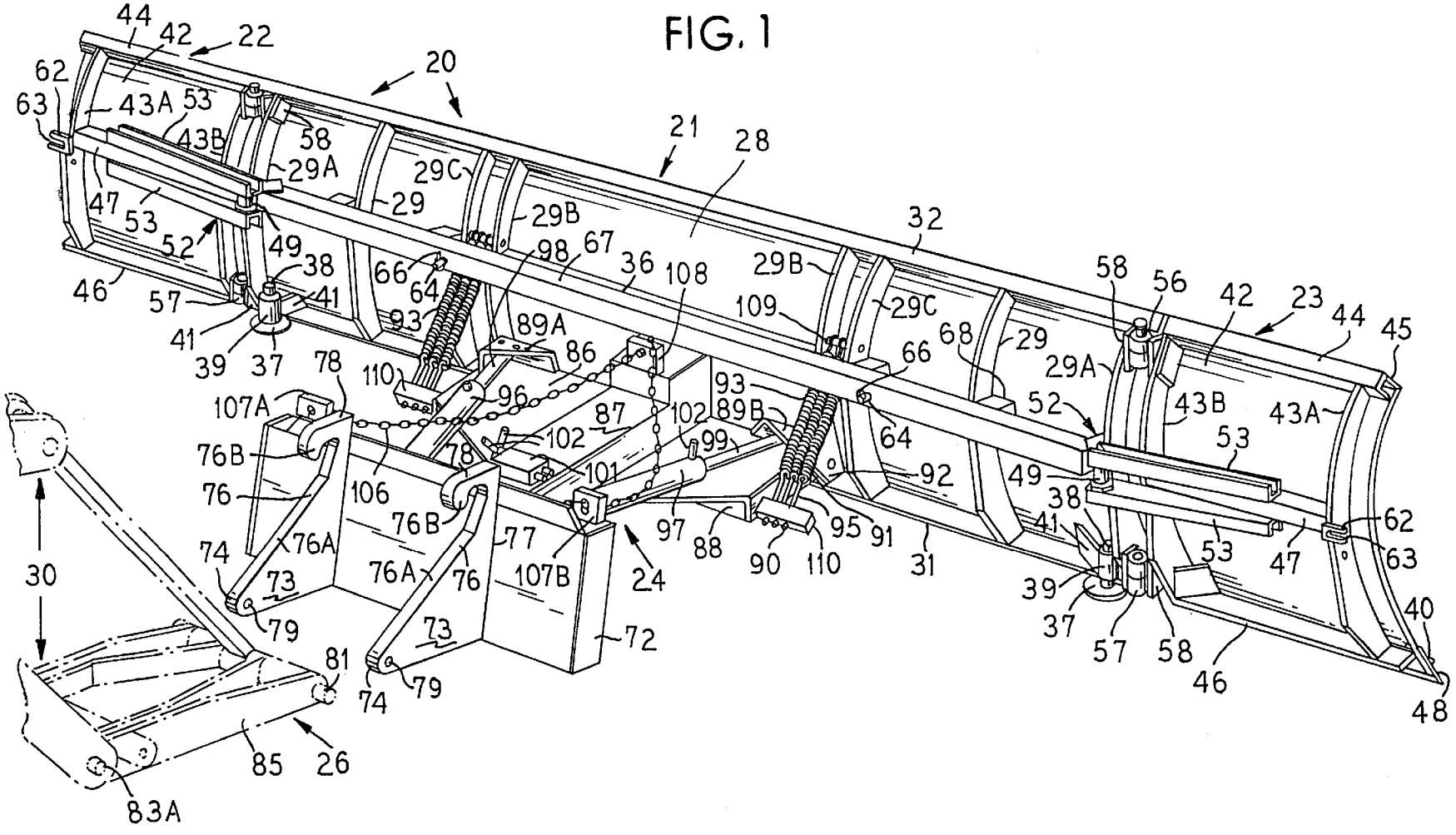
FIG. 1 is a perspective view showing the back side of one embodiment of a vehicle-associatable snowplow with pivotably associated blade end extensions such as a plow being adapted for use in the practice of the present invention.
Figure 2:
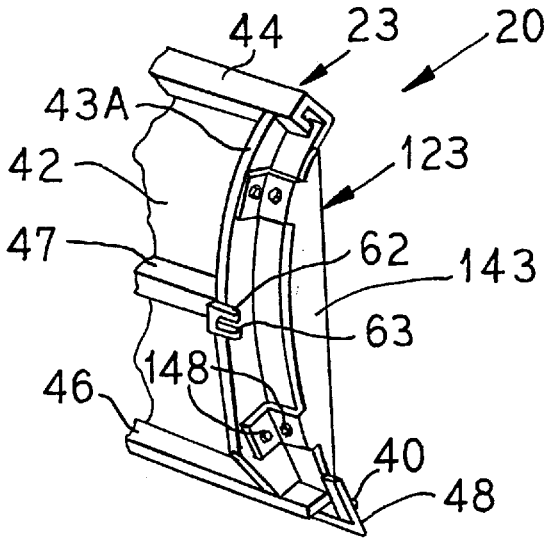
FIG. 2 is a fragmentary view of the right (relative to the vehicle operator) end of the snowplow of FIG. 1 showing this right end equipped with a snow deflector of this invention.
Figure 3:
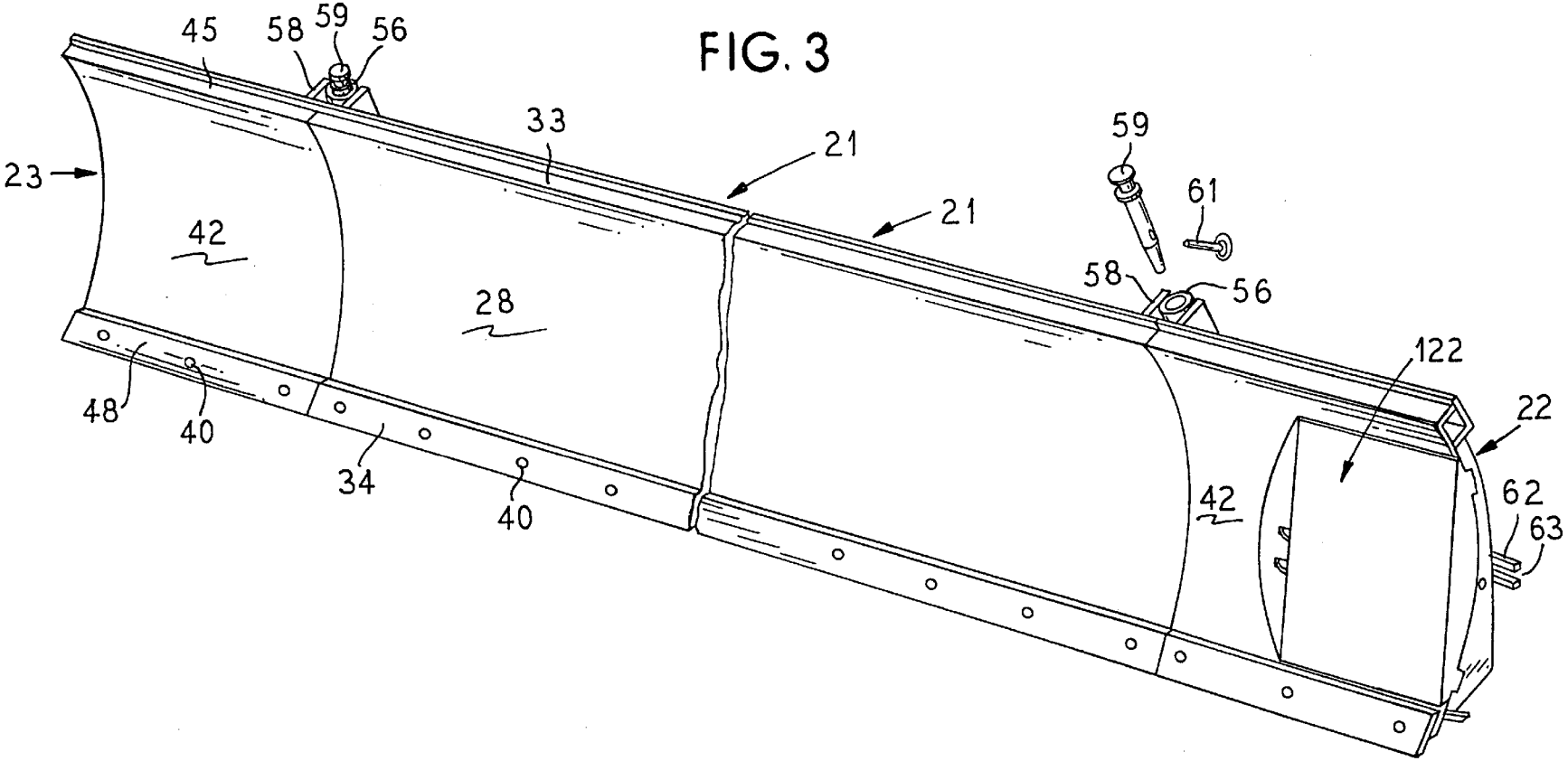
FIG. 3 is a perspective view showing the front side of the snowplow of FIG. 1 with the retaining pin of the left (relative to the vehicle operator) end being shown in an exploded configuration and with the left blade end extension being equipped with the base plate of the snow deflector of FIG. 2.
Figure 4:
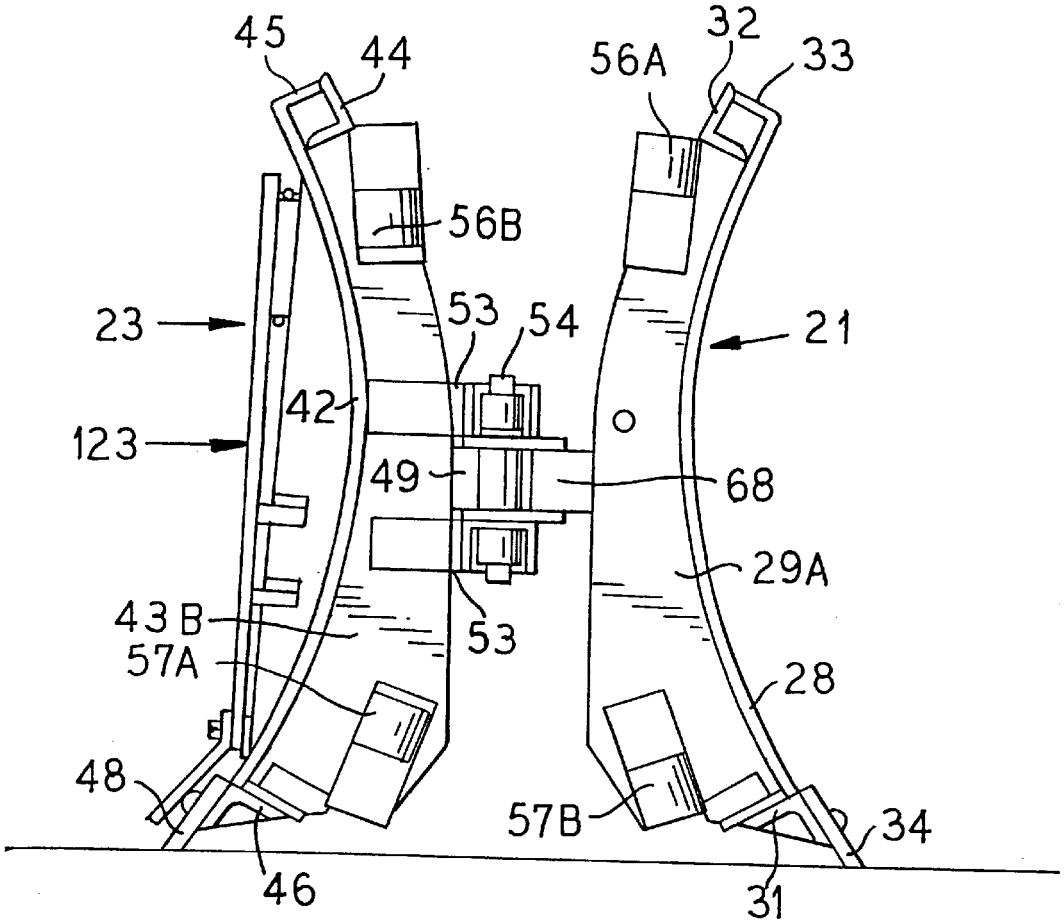
FIG. 4 is a left (relative to the vehicle operator) end elevational view of the snowplow of FIG. 1 wherein the left blade end extension has been pivoted 180° from its fully open position to about its storage position and wherein the snow deflector associated with this extension has been pivoted from its fully open position to its storage position.

Referring to the drawings, FIGS. 1–6 show an embodiment 20 of the inventive snowplow having a blade structure 21 that is equipped at each of its opposite ends with a pivotable blade end extension 22 and 23. The mid-back region of blade structure 21 is provided with a snowplow connection subassembly 24 that is rearwardly connectable with (and disconnectable from) a conventional, generally forwardly extending, hydraulically adjustable mount frame 26 of a support and positioning subassembly 30 that is itself functionally associated with a conventional vehicle, such as an earth moving vehicle or front end loader. The blade end extensions 22 and 23 in FIG. 1 are shown in their respective fully extended configurations (or working positions), and in FIG. 4 are shown in their respective folded storage configurations (or storage positions).

Blade 21 can be variously constructed, as those skilled in the art will appreciate. Typically, blade 21 is elongated and is longitudinally curved so as to present relative to its forward or front face a concavely curved smooth moldboard. Here, blade 21 conveniently is comprised of a sheet metal panel 28 (preferably comprised of steel or a non-rusting ferrous alloy sheeting) which extends substantially continuously on the front face of blade 21 and which is supported and maintained in the desired indicated longitudinally curved configuration by a plurality of longitudinally spaced, vertically oriented, concavely carved ribs 29 that can be variously configured and are preferably formed, for example, of plate steel, formed sheet steel, or the like.

In blade 21, respective individual rib 29 bottom ends are mounted to spaced locations along a longitudinally extending bottom spar 31, and respective rib 29 top ends are mounted to spaced locations along a longitudinally extending top spar 32. Spars 31 and 32 are in spaced, parallel relationship to each other and can be comprised of stock steel such as angle iron or the like. Midway between and parallel to spars 31 and 32 is a third or support spar 36 comprised of lengths that extend between the spaced ribs 29. Preferably spar 36 extends between the adjacent central pair of ribs 29B (as shown in FIG. 1) and which can, if desired, also extend between other adjacent pairs of ribs 29. However, on the out side of each rib 29B, there is positioned a relatively closely spaced adjacent rib 29C. Each adjacent pair of ribs 29B and 29C is thus suitable, if desired, for holding there between the respective top anchors 109 of biasing spring sets 93 (as described below). A present preference is to provide no spar 36 between each adjacent pair or ribs 29B and 29C. The spar 36 can be variously formed of stock steel, such as channel iron or the like.

For snow shedding and structural integrity purposes, the longitudinal top edge of panel 28 is preferably formed into a back-turned flange 33 (see, for example, FIG. 3) while the longitudinal bottom edge of panel 28 is in contacting relationship with top edge portions of a replaceable road-adjacent elongated blade member 34 (as shown for example in FIG. 3). Blade member 34 is comprised of steel or the like, is conveniently connected to, and supported by, the bottom spar 31 with nut and bolt assemblies 40 or the like, and is replaceable (when worn or the like).

The snowplow frame structure of blade 21 thus defined by the spars 31, 32, 36 and the ribs 29 can be secured together by weldments, rivets, or the like (not shown). The panel 28 and also blade member 34 can be mounted to this frame by countersunk machine screws, rivets or the like (not shown).

To support lower edge portions of blade 21 in an upright and contacting relationship with an underlying road, a circular shoe or pad 37 comprised of steel or the like is provided for blade 21 adjacent each opposite end region of the bottom spar 31. Each shoe 37 is mounted centrally to a stub shaft 38 that is slidably received in a vertically oriented sleeve 39 which is welded or the like to an exposed rear edge region of spar 31 and that is preferably also braced by welded braces 41 (conveniently two braces 41 per sleeve 39). A retainer means, such as a cotter pin or the like (not shown) extending through shaft 38, conveniently retains the shaft 38 in association with sleeve 39.

Each blade end extension 22 and 23 is like blade 21 similarly comprised of a face panel 42, a pair of longitudinally spaced curved ribs 43A and 43B, a top spar 44, a bottom spar 46, and a mid-region support spar 47 that is here illustratively preferably a cross-sectionally square tubular steel member. The longitudinal top edge of panel 42 is preferably formed into a back-turned flange 45. Each blade end extension 22 and 23 is, like blade 21, similarly provided and associated with a replaceable, road-adjacent blade member 48 with nut and bolt assemblies 40.

A gate-type hinge assembly 52 is provided for the pivotal movement of each blade end extension 22 and 23. Longitudinally across the back of the blade 21 in transversely backwardly spaced, parallel relationship to the mid-spar 36 a longitudinally extending support bar 67 is positioned. Bar 67 is supported and held by a plurality of support extensions 68 that transversely extend between ribs 29 and bar 67, the extensions 68 being conveniently welded to adjoining portions of the ribs 29 and the bar 67. Bar 67 is preferably comprised of a cross-sectionally square or rectangular steel tube, or otherwise, if desired. Each of the opposite ends of the bar 67 has welded thereto a sleeve 49 whose axis extends vertically. Bracing means for each sleeve 49 can additionally be employed if desired (not generally detailed). Each sleeve 49 can be transversely backwardly (relative to blade 21) offset from bar 67, if desired, by brace members or the like.

Various hinge arm arrangements can be employed. Here, illustratively, a pair of hinge arms 53 is provided for each blade end extension 22 and 23. Each arm 53 is conveniently comprised of channel iron or the like. One end and its end adjacent portions of the main or back outside face of each arm 53 are joined by welding or the like to a different portion of the respective upper and lower edges of each mid spar 47 of each one of the blade end extensions 22 and 23. The members of each pair of arms 53 thus angularly extend in spaced, parallel relationship to each other. Bracing means for each arm 53 can additionally be employed, if desired, such as braces which extend between rib 43B and each arm 53. The length of each arm pair 53 and their common angle of extension is such that the extended ends of each arm pair 53 overlie in adjacent relationship a different respective opposite end of one sleeve 49. A broad region of support for each extension 22 and 23 by its associated arm 53 is thus provided. The combination of bar 67 and arm pairs 53 makes possible a hinge assembly which is not only strong, but also compensates for the curvature of the blade 21 and its associated extensions 22 and 23.

Each arm pair 53 thus terminates in adjacent relationship to a terminal rib 43B of an extension 22 or 23 and to a terminal rib 29B of blade 21.

Each hinge arm pair 53 is thus aligned with opposite end of a different sleeve 49. Each hinge arm 53 is provided with a hole in its main face that is aligned with the channel in the adjacent sleeve 49. Thus, when a retaining pintle 54 (see FIG. 4) is extended through the members of each arm pair 53 and each adjacent sleeve 49, the gate hinge assembly 52 is completed. Each pintle 54 is preferably provided with retaining means.

Thus, when the snowplow 20 is slightly elevated above ground level (by the operator in vehicle 27), starting from its blade extended position (see FIG. 1, for example), each blade end extension 22 and 23 is continuously and unobstructedly pivotable about an axis defined by the center of each pintle 54 through an angle of at least about 175°. This angle can actually be somewhat greater than 180° as when an extension 22 or 23 is in its storage configuration (see FIG. 4). Thus, each blade end extension 22 and 23 is pivotably and continuously movable from its blade extended position (see FIG. 1) to its respective storage position (see FIG. 4). When in its storage position, each blade end extension 22 and 23 is located so as to extend along a different respective back side end adjacent portion of blade 21. Thus, in this storage position, the respective back face of each of the blade end extension 22 and 23 extends in adjacent relationship to the adjoining end adjacent portion of the back face of the blade 21 and has been pivoted through an angle somewhat greater than 180° relative to the fully extended position.

Latch means is provided for retaining each of the blade end extensions 22 and 23 in its respective blade extended position and in its blade storage position, whichever respective one of such positions each blade end extension 22 and 23 happens to be occupying. Various retaining (latch) means can be employed, but latch means that incorporate reversibly insertable or positionably retaining pin means are presently preferred.

Thus, to retain each blade end extension 22 and 23 in its blade extended configuration (see FIG. 1), a present preference is to employ (as shown) at least one and preferably two retention ring and pin arrangements per blade end extension. Here, illustratively, two pairs of generally vertically aligned ring member pairs 56 and 57 respectively are preferably provided at the upper and lower areas of each end of blade 21 (four pairs in all) adjacent each extension 22 and 23. Each pair 56 and 57 is positioned so that each member of each ring member pair 56 and 57 is generally coaxially aligned with the other member when each blade extension 22 and 23 is in its blade extended position at its respective associated opposite end of blade 21. An upper ring member pair 56 is located adjacent to top spars 32 and 44 and between the end adjacent ribs 29A and 43B. Braces are also preferably employed for mounting by welding or the like each pair 56 and 57. A lower ring member pair 57 is located adjacent to bottom spars 31 and 46 and between the end adjacent ribs 29A and 43B. The upper ring member pairs 56 (comprised of ring members 56A and 56B) are preferably oriented so to have a common vertically oriented axis while the lower ring member pairs 57 (comprised of ring members 57A and 57B are preferably oriented so as to have a common inclined axis when viewed in end elevation (see FIG. 4, for example).

For support and positioning purposes, each ring member pair 56 and 57 is provided with, and is located between, and is fastened by welding or the like to, individual members of a plate pair 58 (four plate pairs 58 in all). One member of each plate pair 58 is fixed relative to one terminal rib 29A and the other member of each plate pair is fixed relative to one terminal rib 43B. Ribs 29A and 43B are arranged to be in longitudinally spaced parallel relationship to one another. In each ring member pair 56 and 57, one ring member is fixed to one member of each plate pair 58, and the other member of that ring member pair is fixed to the second member of each plate pair 58; hence, one ring member of each ring member pair 56 and 57 is fixed to blade 21 while the other is fixed to one blade end extension 22 or 23 (as the case may be). The respective members of each ring member pair 56 and 57 are generally positioned to be vertically adjacent and coaxially aligned relative to each other when each blade end extension is in its open (or working) position. In such blade extended position, the aligned ring members of each pair 56 and 57 are each adapted for association with a slidably associatable retaining pin 59 (see FIG. 3). It is presently preferred to provide each pin 59 with a removable locking pin 61 (see FIG. 3) for pin 59 retention purposes when each blade end extension 22 and 23 is in its blade extended configuration (such as shown in FIG. 1).

When blade end extensions 22 and 23 are in their blade extended positions relative to blade 21, the combination of the ring member pairs 56 and 57 and their associated respective pins 59 function to rigidify, strengthen and support the resulting assembly as is desirable when plowing snow.

To retain each blade end extension 22 and 23 in its blade extension storage configuration (see the illustration in FIG. 4), a present preference is to employ a stub shaft and retaining pin arrangement. The outside end rib 43A of each blade end extension 22 and 23 is provided (by welding or the like) with an outwardly extending plate engagement tab 62 which is preferably provided with a longitudinally elongated, open ended notch 63 (see, for example, FIG. 1). Aligned with the notch 63 of each tab 62 when each of the blade end extensions 22 and 23 is pivoted into its storage configuration is a stub shaft 64 whose inner end is butt welded or the like to bar 67 so as to cause shaft 64 to transversely project rearwardly and perpendicularly therefrom. When shaft 64 projects through notch 63, a retaining pin 66 can be associated with shaft 64 to retain tab 62 in association with shaft 64.

The snowplow connection subassembly 24 can be variously constructed. The interrelationship between this connection subassembly 24 and the combination of blade 21 with the blade end extensions 22 and 23 and their latch members (such as described above) is such that this connection subassembly 24 is located on the back side of blade 21 so as to be longitudinally midway between each of the blade extensions 22 and 23. Thus, the connection subassembly 24 is in non-interfering relationship with the extensions 22 and 23 both when the extensions 22 and 23 are in their respective storage configurations (or positions), and when the extensions 22 and 23 are pivotably moving towards or away from these storage configurations. The connection subassembly 24 is thus characteristically connected to a mid-region of each back of blade 21.

One presently preferred embodiment of a snowplow connection subassembly 24 is employed in the snowplow 20 although other arrangements can be used.

Here, connection subassembly 24 employs a push frame 86 comprised of heavy gauge formed plate steel or the like. The longitudinal width and the transverse length of the push frame 86 are such that the frame 86 is in non-interfering relationship with the end extensions 22 and 23. Frame 86 includes a transversely extending central column 87 with a raised forward portion and with a medial, longitudinally extending cross brace 88. A pair of brackets 89 are provided which are similarly comprised. Each bracket 89A and 89B is fixed to and supported by a different rib 29B and spar 31 or otherwise. Opposite forward portions of side flanges 91 are secured to frame 86 by welding or the like. Alternatively, flanges 91 can be part of a box section associated with frame 86, if desired. The longitudinally spaced flanges 91 are preferably nestably received between longitudinally spaced vertical portions of the respective brackets 89. Each flange 91 is pivotably associated with its adjacent bracket 89 by a different one of a pair of generally horizontally oriented, generally coaxial support shafts 92 (the end of one support shaft 92 being shown in FIG. 1). Each shaft 92 extends between a different one of a pair of components comprising a flange 91 and an outside vertical portion of a bracket 89. Each bracket 89 is thus pivotable relative to shaft 92 and flange 91. Thus, while the push frame 86 is generally horizontally oriented (as shown for example in FIG. 1), the assembly of blade 21 with the associated extensions 22 and 23 (whether or not these extensions are in their extended or storage configurations) is pivotable relative thereto about an axis corresponding to the axis of shafts 92. Such pivotability is desirable as a means for avoiding damage to the blade 21 or the extensions 22 and 23 when and if the blade 21 or an extension 22 and 23 strikes an object on a roadway that is being plowed with snowplow 20 to remove accumulated snow. Thus, when such an object is struck, the blades 34 and 48 (when the extensions 22 and 23 are in their fully extended configuration) swing transversely rearwardly while the top spars 32 and 44 swing transversely forwardly.

To maintain the blade 21 and associated extensions 22 and 23 biased in a normally upright configuration, two sets 93 of biasing tension springs are provided. Each spring set 93 illustratively is here comprised of three coiled steel springs or the like. Each set is mounted under tension between a top anchor 109 and a bottom anchor 110. Each top anchor 109 is mounted between a different pair of ribs 29B and 29C preferably just above bar 67 and spar 36. Each bottom anchor 110 is mounted to extend longitudinally outwardly from a different side flange 91 in opposed relationship.

Preferably, and as shown (see FIG. 1 for example), each tension spring of each spring set 93 is terminally associated with a rod 95. By adjusting the effective length of each rod 95 through turning a nut 90 that threadably engages the rod 95 end after it has been extended through the anchor 110, the tension of the associated spring is adjustable, as desired.

Tilting of, for example, blade 21 about the horizontal axis defined by shafts 92 causes the spring tension force exerted by the spring sets 93 to urge the blade 21 back into its normal upright position (as illustrated in FIG. 1). A limiting stop means that sets this normal position can be variously achieved; for example, the stop means can be provided by abutting engagement between spar 36 and the forward upper portion of column 87. Obstruction relieving pivoting action for a snowplow blade about a horizontal pivot axis has heretofore been known, but such an action has never previously been employed with a snowplow blade having pivotable end extensions, such as here provided, so far as now known.

The rearward terminal region of push frame 86 is joined to a preferably rectangularly configured reference plate 72 comprised of steel plate or the like that extends longitudinally across the terminal rear end of the push frame 86. The reference plate 72 is typically somewhat inclined as when the snowplow 20 is not in use so that its top edge is displaced forwardly of its bottom edge, but plate 72 can be generally vertically oriented if desired.

In snowplow 20, the reference plate 72 is preferably pivotably but conventionally joined to the push frame 86 for allowing pivotal movements of frame 86 relative to reference plate 72 about a horizontal axis so that in use plow 21 can ascend or descend as on sloping ground (since, in use, plow 21 and extension 22 and 23 lead the vehicle 27). To provide a stop means for limiting the extent of downward horizontal axis pivoting of the plow 21 relative to the plate 72, a chain 106 is provided. The chain 106, as shown for example in FIG. 1, extends in connected relationship from a bracket 107A that is welded or the like on the upper left hand corner (relative to the operator of vehicle 27) of the plate 72 to a bracket 108 that is welded or the like on the top forward center portion of the central column 87 and to a bracket 107B that is welded or the like on the upper right hand corner of the plate 72.

When the snowplow 20 is generally in a resting configuration, where the plate 72 and the plow 21 (and extensions 22 and 23) are ground engaged, the chain 106 is in a limp configuration. However, when the plow 21 (and extensions 22 and 23) is supported in an above ground elevated condition by the support and positioning assembly 30, the chain 106 becomes taught since it is limiting the downward extent of pivoting about such horizontal axis of plow 21 (and extensions 22 and 23) relative to plate 72. The forward central terminal region of push frame 86 is pivotably associated with a normally vertically oriented shaft 94 that is illustratively rigidly supported by and connected to spar 31 (connection means not detailed).

Thus, with the push frame 86 in a stable orientation, the blade 21 (and associated extensions 22 and 23) is pivotably movable from side to side about the axis of an interconnecting shaft. The relationship between this shaft and push frame 86 is preferably such that tilting of plow 21 about the horizontal tilt axis defined by shafts 92 is independent of the pivoting of plow 21 about the vertical axis defined by the shaft. The relationship between this shaft and push frame 86 is preferably such that pivoting of plow 21 about the vertical axis of this shaft is typically accomplished with the push frame 86 being generally horizontally oriented. Preferably, there is no interference with the tiltability of plow 21 about the horizontal axis defined by shafts 92 during pivoting about the vertical axis of this shaft. Preferably, pivotability of plow 21 about the vertical axis of this shaft extends through an angle of at least about 25° on either side of a (hypothetical) transverse center line of the push frame 86 which line passes through the axis of this shaft.

To guide and control the pivotal movements of, and to achieve a chosen fixed position for, the plow 21 (and the associated extensions 22 and 23) relative to the push frame 86 and the reference plate 72, a pair of conventional hydraulic double acting cylinders 96 and 97 are provided which are oriented in spaced relationship to one another in a common horizontal plane that is substantially aligned in parallel relationship with push frame 86. The forward end of the extendable and retractable rod 98 of cylinder 96 is pivotably connected to the left bracket 89A while the rear end of cylinder 96 is pivotably connected to a post on the left rearward side (relative to the driver of vehicle 27) of push frame 86. The forward end of the extendable and retractable rod 99 of cylinder 97 is pivotably connected to a post on the right bracket 89B while the rear end of cylinder 97 is pivotably connected to the right rearward side (relative to the driver of an associated vehicle), of push frame 86. The fluidic pressure on the rod-associated piston (not detailed) in each of the cylinders 96 and 97, and the resulting extended position of each rod 98 and 99, respectively, is regulated by the conventional hydraulic fluid distribution valve 101 with which each of the cylinders 96 and 97 is conventionally connected by two flexible conduits 102 (which are not fully detailed). Valve 101 functions so that extension of one rod, such as rod 98 causes retraction of the other rod, such as rod 99. The respective extended positions of each rod 98 and 99, and, consequently, the pivot position of the blade 21 (and its extensions 22 and 23) is conveniently remotely controlled preferably by the selected position of a single control lever set by the operator of the associated vehicle. A valve set switch can be provided for operator use in fixing the pivot angle at a given blade position after pivoting to a desired blade position.

In addition to such operator control, the valve 101 is preferably provided with a pair of conventional pressure transducers (not detailed), each one of which is responsive to (that is, senses) sudden fluidic compression force increases in an individual cylinder 96 or 97. Such an increase in fluidic force is caused when an obstruction (such as a post) is struck by either the right or left side of the blade 21 (or of on extension 22 and 23 that is fully extended in an operative configuration relative to blade 21). When such a fluidic pressure increase exceeds a set point pressure level, the valve 101 opens (ports) for the affected cylinder and constructs for the other cylinder, thereby resulting in immediate fluid pressure release in the affected cylinder and thereby resulting in the backward pivoting of the blade 21 (and extension) on the side thereof that is in contact with the obstruction. Such release and pivoting avoids damage to the impacting blade 21 and/or the impacting blade extension 22 or 23, as the case may be.

For purposes of pivotability about a vertical axis, one can if desired employ the combination of blade 21 and extensions 22 and 23 with a snowplow connection subassembly that does not employ hydraulic positioning means and that instead employs a manual horizontal pivoting (about a vertical axis) and a mechanical locking arrangement for a blade 21 in a desired angular position; such an arrangement is not detailed herein.

Thus, the extensions 22 and 23 in the indicated combination with blade 21 do not interfere with pivotal blade movements about either a horizontal or a vertical axis.

To minimize manual operations, the rear face of plate 72 is here preferably (and as shown) connected by welding or the like to a pair of symmetrically positioned, longitudinally spaced, parallel, vertically oriented grappling plates 73 comprised of steel or the like. Each plate 73 has a forward edge 77 that is abuttingly engaged by welding or the like with the rear face of the reference plate 72, and a rear edge 76 which is contoured. Thus, rear edge 76, commencing at the bottom rearwardmost corner region 74 of plate 73, progressively extends upwardly and forwardly to define a ramp portion 76A. Ramp portion 76A terminates at its upper end in an overlying, rearwardly opening grappling hook 76B that is defined in the upper rear edge of plate 73 located adjacent to, but beneath, the top edge 78 and that is also laterally adjacent to the forward edge 77. Each plate 73 has defined therethrough adjacent to the bottom of the bottom corner 74 at the beginning of ramp 76A a longitudinally extending aperture 79.

Each of the opposite terminal end regions of the forward, horizontally extending cross bar 81 of mount frame 26 of the conventional (not part of this invention) support and positioning subassembly 30 of the associated vehicle is adapted to engage the ramp 76A of each grappling plate 73 as the vehicle 27 advances and as cross bar 81 is elevated by the operator-controlled advance of vehicle 27. As the vehicle 27 advances from the position shown in FIG. 1, the cross bar 81 slidably advances, engages ramp 76A and moves up each of the ramps 76A as shown, for example, in FIG. 4. This movement continues until the cross bar 81 advances to the top location along rear edge 76 shown in FIG. 5 where each of the cross bar 81 opposed end regions is fully engaged with a different hook 76B. Each grappling plate 73 is then located adjacent to and along the out side of a different cross bar support 85. Each aperture 79 is aligned with a shaft 83A that is here associated with an elbow region of the mount frame 26.

Shaft 83A is now manually or hydraulically inserted through the aligned aperture 79, thereby securing the grappling plates 73 and completing a mounting of snowplow 20 to the support and positioning subassembly 30. The hydraulic lines between vehicle 27 and the snowplow 20 are connectable by conventional so-called "quick" connect/disconnect fittings (not shown).

With each of the grappling plates 73 thus connected to the mount frame 26, further advance of the vehicle 27 and further elevation of the mount frame 26 results in the elevation of snowplow 20 into an aboveground position.

When snowplow 20 is being used for plowing snow with the blades 48 and 34 generally ground engaged, the height control hydraulic cylinder of the support and positioning subassembly 30 can in some arrangements be set in a neutral position so that the piston thereof is effectively non-pressurized. With such an arrangement, the leading (relative to the associated vehicle) plow 21 and the extensions 22 and 23 can ride over a ground surface which is rising (ascending) or falling (descending) relative to the position of the wheels of the following associated vehicle, with the plate 72 being fixed relative to push plate 86, as those skilled in this art will readily appreciate.

To improve the snow removal efficacy of the snowplow 20, particularly when the blade structure 21 is used in an inclined orientation relative to a vertical axis, each of the blade end extensions 22 and 23 can be associated with a snow deflector subassembly 122 and 123, respectively. The snow deflector assembly 123 is illustrative and is now described. The snow deflector subassembly 122 has a structure that corresponds to that of the snow deflector subassembly 123 except that the subassembly 122 is in effect a mirror image of the subassembly 123, thereby to permit association of the subassembly 122 with the blade end extension 22 while the subassembly 123 is in association with the blade end extension 23. Corresponding parts of the subassembly 122 thus can be considered to be similarly numbered relative to parts of the subassembly 123.

Figure 5:
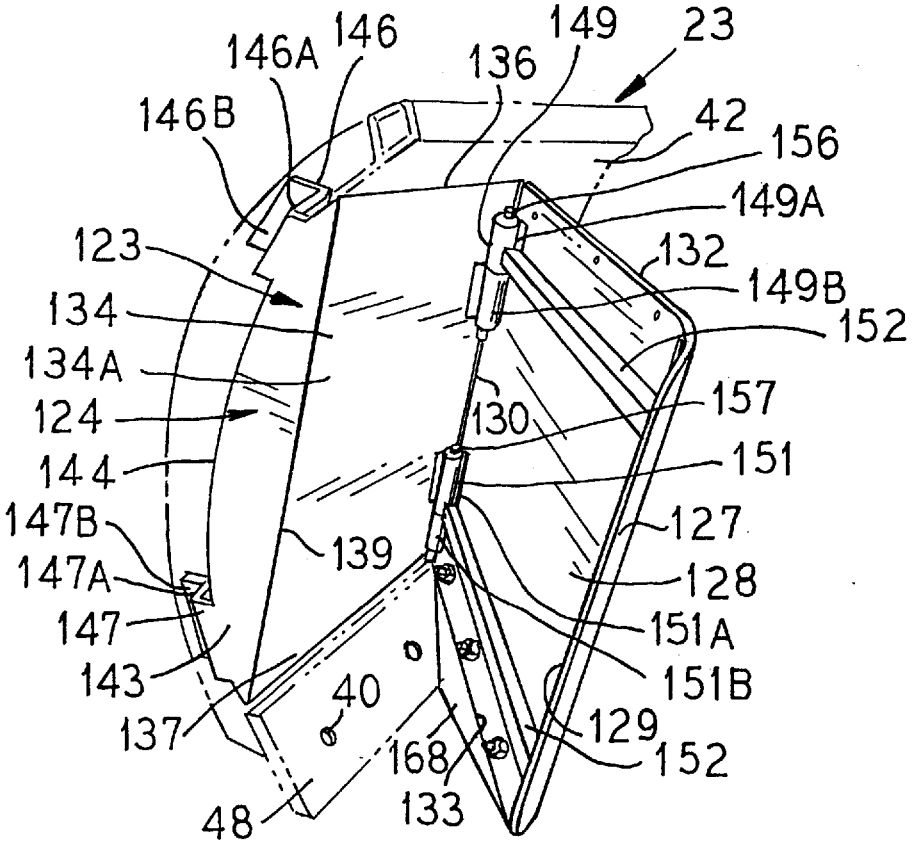
FIG. 5 is a right (relative to the vehicle operator) end elevational perspective view of the snowplow of FIG. 1 wherein the right blade end extension is equipped with a snow deflector assembly, this deflector assembly here being shown with its being in its spring-biased, normal, fully-extended position relative to its base plate which is hingedly associated with the deflector.
Figure 6:
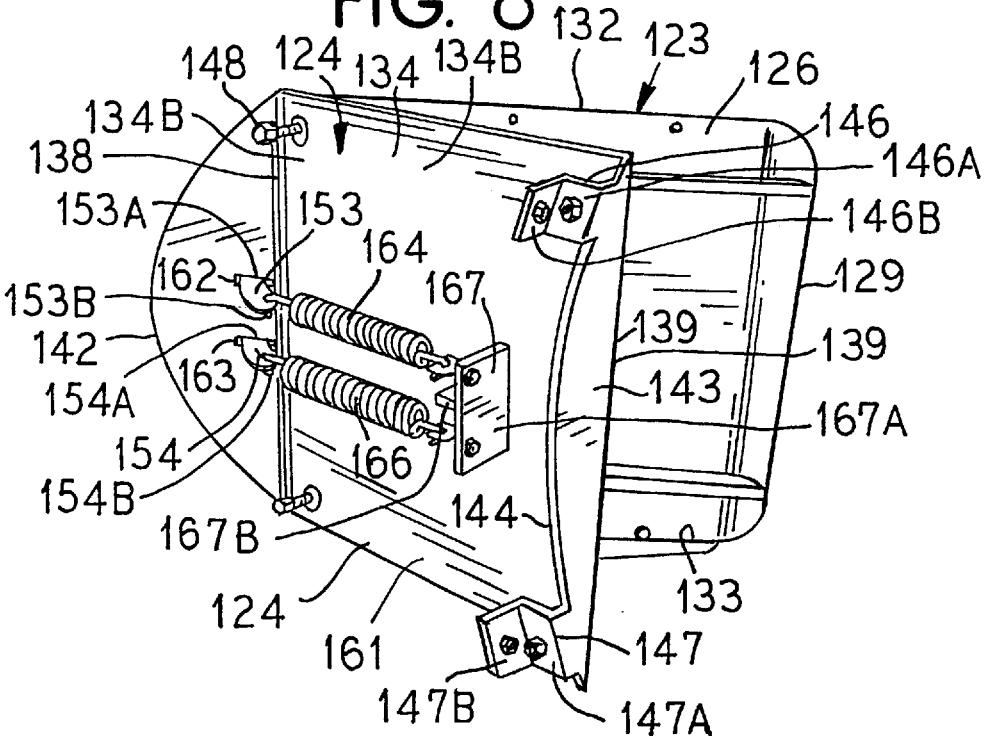
FIG. 6 is a perspective view of the back side of the base plate of the deflector assembly shown in FIG. 5.
Figure 7:
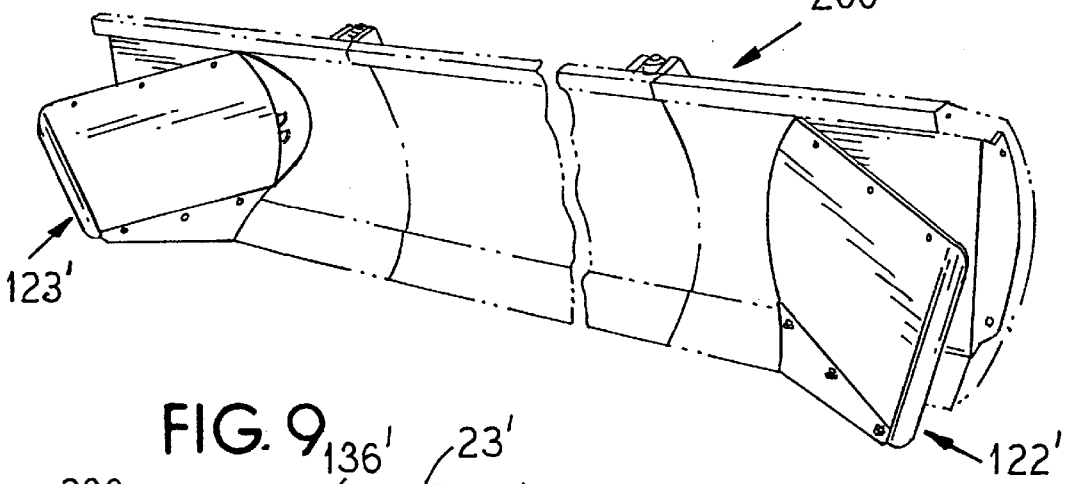
FIG. 7 is an environmental perspective view showing the front side of another embodiment of a snowplow that is vehicle-associatable and that is equipped with pivotably associated blade end extensions which are each equipped with a snow deflector assembly.
Figure 9:
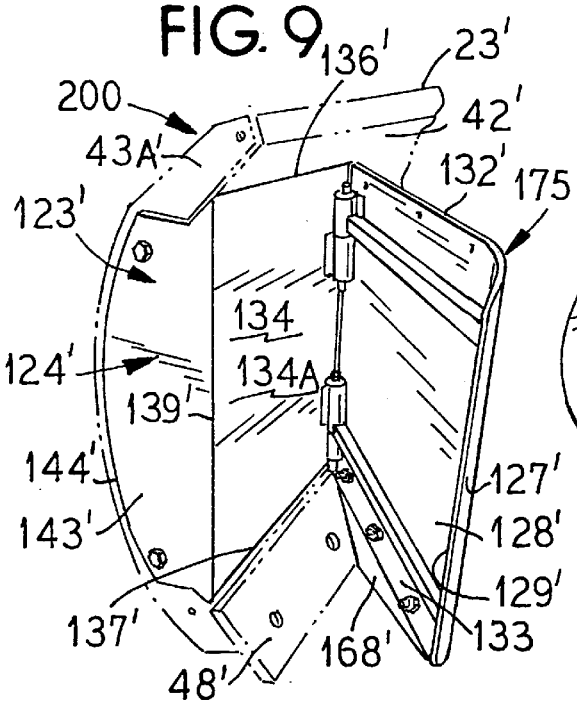
FIG. 9 is a view similar to FIG. 5, but showing the end region of the snowplow of FIG. 7 equipped with the deflector assembly shown in FIG. 7.
Figure 10:
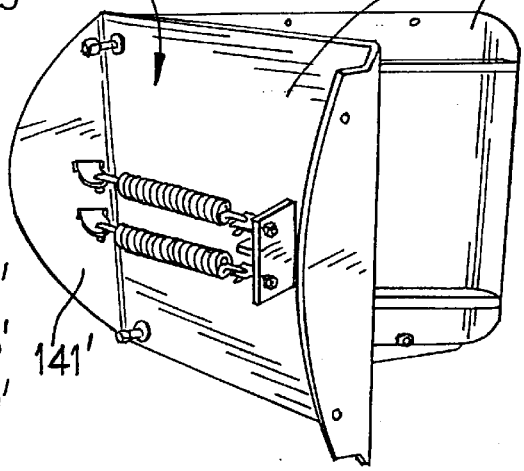
FIG. 10 is a view similar to FIG. 6, but showing the deflector assembly of FIG. 7.

The snow deflector assembly 123, as illustrated, for example, in FIGS. 4–6 incorporates a base 124 and a deflector plate 126. The deflector plate 126 has a generally flat configuration with opposed outside and inside facial surfaces 127 and 128, generally parallel outside and inside side edge portions 129 and 130, and generally parallel top and bottom edge portions 132 and 133 that extend generally perpendicularly to the outside and inside edge portions. Top and bottom corner portions of the outside edge portions 129 are preferably rounded. Plate regions adjacent to the outside edge portions 129 are preferably curved so that, adjacent to the outside edge portions 129, the outside surface portions 127 extend convexly relative to the opposed inside surface portions 128 which extend concavely. Thereby, movement of the outside edge portions 129 through snow is enhanced as the snowplow 20 advances when in use.

The plate 126 and the base 124 are preferably comprised of formed sheet metal (preferably steel or a non-rusting ferrous alloy).

The base 124 has a medial, generally quadrilaterally configured flat region 134 with terminal top and bottom edge portions 136 and 137 and with opposed outside and inside facial surfaces 134A and 134B. The inside and outside side edge portions 138 and 139 of the flat region 134 are in spaced, parallel relationship relative to each other and are each conveniently defined by respective fold or bend lines in the sheet stock comprising the base 124.

Extending inwardly and diagonally from the inside side edge portion 138 of the flat region 134 is a flat spacer 141 which has a generally continuously curved terminal edge 142 that extends from the top to the bottom of the flat spacer 141 and the inside side edge portion 138. The curvature of this curved edge 142 is selected so as to generally match the curvature of the outside surface of the panel 42 of the blade end extension 23. When base 124 assembled with the blade end extension 23, the curved edge 142 of the flat spacer 141 is in adjacent, contiguous relationship with panel 42 outside surface portions.

Extending outwardly and perpendicularly from the outside side edge portion 139 of the flat region 134 is a flat spacer 141 which has a generally continuously curved terminal edge 144 that extends from the top in the bottom of the outside side edge portion 139. The curvature of this curved edge 144 is selected so as to generally match the outside edge portions of the panel 42 of the blade end extension 23. Thus, when assembled with the blade end extension 23, the curved edge 144 of the flat spacer 143 preferably overlies and is in adjacent, contiguous relationship with the outside edge portions of the panel 42.

To permit the base 124 to be conveniently mounted to the blade end extension 23, top and bottom adjacent portions of the curved terminal edge 144 of the flat spacer 143 are each provided with a tab member 146 and 147, respectively. Along the edge 144, each tab member 146 and 147 is folded perpendicularly so as to provide a first region 146A and 147A, respectively. Each first region 146A and 147A has an inside face that is in adjacent, contiguous relationship with a different back face portion of the panel 42. Each first region 146A and 147A is terminated by a fold line which results in the formation of a terminal second region 146B and 147B, respectively. Each of these second regions 146B and 147B extends perpendicularly relative to its connected first region 146A and 147A. The open face of each second region 146B and 147B is in adjacent, contiguous relationship with a different side face portion of the rib 43A. Conventional fastening means, here preferably nut and bolt assemblies 148, mount each first region 146A and 147A to the panel 42, and each second region 146B and 147B to rib 43A. The top and bottom corner regions adjacent to the inside side edge 138 of flat region 134 are each mounted to the respective adjacent portions of the panel 42 by conventional fastening means, here preferably nut and bolt assemblies 148.

The inside and outside flat spacers 141 and 143 position the flat region 134 generally in a spaced relationship relative to the adjacent surface portions of the panel 42 thus defining a cavity 161 between the panel 42 and adjacent portion of the base 124 with the top and bottom edge portions 136 and 137 of flat region 134 extending generally laterally along and in adjacent relationship to the top and bottom edge portions of the plow 20.

Hinge means is provided to interconnect pivotably the deflector plate 126 with the base 124. In deflector 122, a pair of hinges 149 and 151 are employed each of which has an upper knuckle 149A and 151A and an adjacent vertically aligned lower knuckle 149B and 151B, respectively. Each of the upper knuckles 149A and 151A is fastened conveniently by welding or the like to the inside surface 128 of deflector plate 126 in equally spaced, adjacent relationship relative to the inside edge 130 of deflector plate 126. Each of the lower knuckles 149B and 151B is fastened conveniently by welding or the like adjacent to the inside side edge 138 of the plate region 134 on the outside surface of 34A thereof. When a pintle 156 and 157 is extended through each of the aligned upper and lower knuckles 149A, 149B and 151A, 151B, the deflector plate 126 is pivotably movable about a preferably vertical pivot axis relative to the base 24 with the outside edge 129 of deflector plate 126 being movable towards and away from the region of the outside side edge 139 of flat region 134.

The deflector plate 126 for reasons of improving structural rigidity is preferably provided (as shown) with a pair of connected (by welding or the like) cross bars 152 which generally extend laterally across the inside surface 128 of deflector plate 126.

The deflector plate 126 is provided with arcuate arm means preferably adjacent to its inside edge 130. In the deflector 122, a pair of flattened, vertically spaced parallel arcuate arms 153 and 154 are utilized. Each arm has a proximal end 153A and 154A which is here connected by welding or the like to the inside surface 128 of plate 126 at a location that is adjacent to the inside edge 130 of plate 126, but that is preferably laterally offset from the (hypothetical) line of the pivot axis of plate 126, thereby to provide leverage for the spring initiated and controlled yielding biasing achieved as herein described. Each arm 152 and 153 extends backwards from the outside surface 127 of plate 126 and each arm 152 and 153 has a distal end 153B and 154B which terminates in the cavity 161 after each arm 153 and 154 passes through an aperture 162 and 163, respectively, defined in flat spacer 141.

In the cavity 161, spring means is provided for biasing purposes. Those skilled in the art will appreciate that many different yielding means can be employed for outwardly biasing the deflector plate 126. In the deflector 122, a pair of vertically spaced parallel, horizontally extending coiled compression springs 164 and 166 are located in the cavity 161. Near the flat spacer 143 on inside surface 134B of flat region 134 an anchor 167 is mounted by welding or the like. The anchor 167 includes a cross plate 167A and a brace plate 167B as shown, for example, in FIG. 6. One end of each spring 164 and 166 is connected to the anchor 167. The opposite end of each spring 164 and 166 is connected to the distal end of 153B and 154B of each arm 153 and 154. The springs 164 and 166 thus exert a tensioning action which operates to biase the deflector plate 126 outwardly with the outside edge 129 being yieldingly held away from the outside edge 139 of flat region 134.

The bottom edge 133 of deflector plate 126 is here associated with an elongated, generally triangularly configured blade 168 that is preferably adapted for maintaining the lower portions of plate 126 in ground engagement during operation of snowplow 20. The blade 168 is preferably comprised of resilient, elastomeric material so that, even when the plate 126 is deflected when engaged with snow, the blade 168 maintains ground contact at least until the plate 126 has reached its position of maximum deflection where the plate 126 is approximately or nearly adjacent to the flat region 134.

As those familiar with this art will readily appreciate, the snow deflector components are arranged and configured to move snow without becoming snow bound. Various alternative components and component arrangements are possible without departing from the spirit and scope of the invention.

The snow deflector of this invention is well suited for association with a wide variety of snowplows. For one example, the snow deflector can be employed with blade end extensions which are not pivotable as in the snowplow 20, but which are either fixed to blade end regions or detached therefrom. For another example, the snow deflector can be employed with snowplow blades which are not provided with blade end extensions. In such a situation, the snowplow deflector of the invention is associated with at least one end of an elongated straight blade means having a smooth, longitudinally and concavely curved forward face, opposite ends, a backface and top and bottom edge portions.

Figure 8:
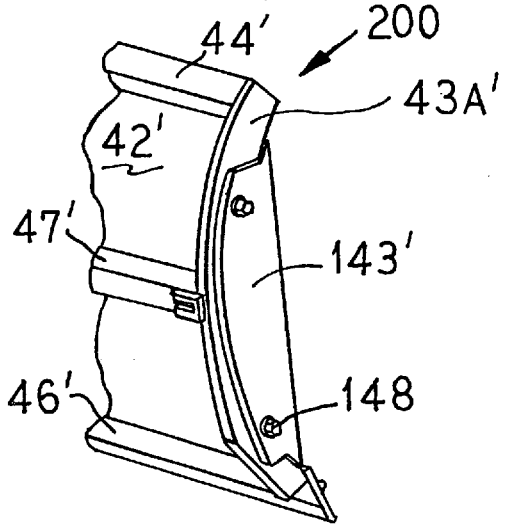
FIG. 8 is a view similar to FIG. 2 but showing the right blade end extension of FIG. 7 equipped with the snow deflector assembly of FIG. 7.

The base of the deflector assembly is readily and simply altered or adapted for use with different blade structures. For example, one alternative embodiment of a snow deflector of the present invention is illustratively shown in FIGS. 7–17. Here, the snowplow 200 is similar to the snowplow 20. Similar parts are similarly numbered but with prime marks added thereto for identification purposes. In snowplow 200, the end ribs 43A have been relocated outwardly on each of the blade extensions 21' and 22' so that the end ribs 43A' are practically flush with the outer edge of each panel 42'. This arrangement is advantageous because, as shown in FIG. 8, it permits the outside flat spacer 143' of the snow deflector assembly 175 to be directly connected by nut and bolt assemblies 148 to the rib 43A' without the use of any tab members or the like.

Except for the elimination of the tab members 146 and 147 from the outside flat spacer 143, as in the snowplow embodiment 122 above described, the snow deflector 175 is similar to the snow deflector 122. Similar parts are similarly numbered but with prime marks added thereto for identification purposes.

Figure 11:
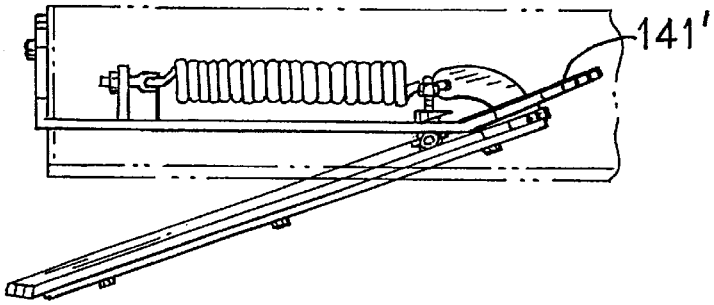
FIG. 11 is a top plan view of the deflector assembly of FIG. 7.
Figure 12:
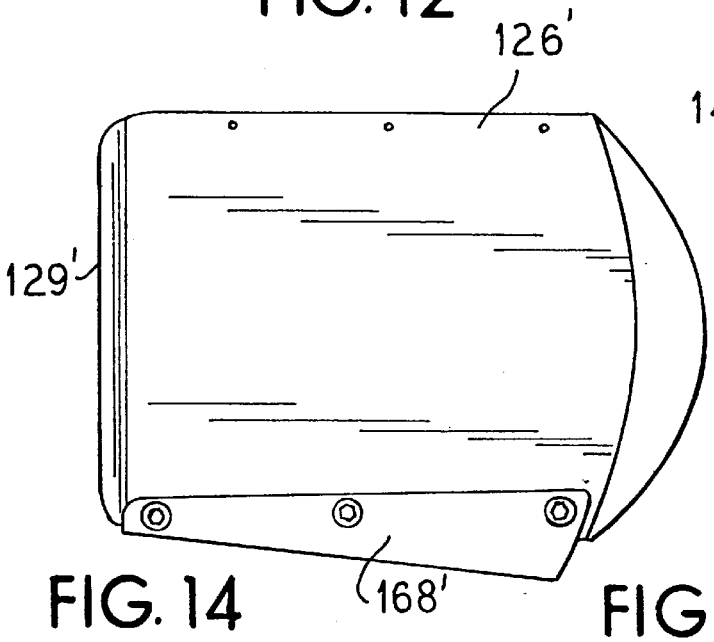
FIG. 12 is a front elevational view of the right (relative to the operator) deflector of the deflector assembly of FIG. 7.
Figure 13:
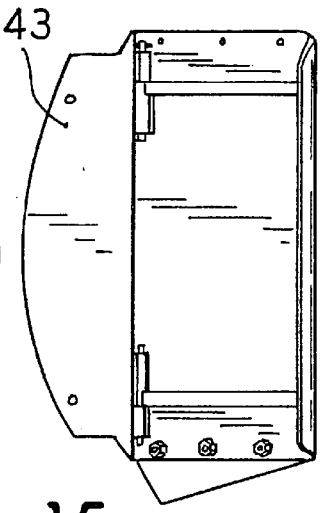
FIG. 13 is a right (relative to the operator) side elevational view of the right (relative to the operator) deflector assembly of FIG. 7.
Figure 14:
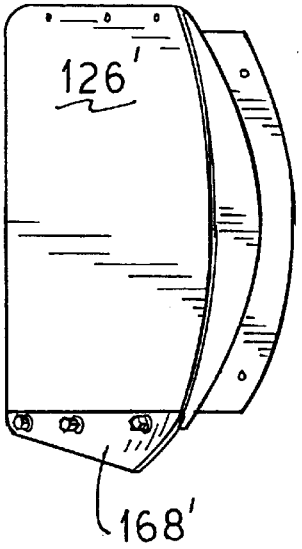
FIG. 14 is a view similar to FIG. 13, but showing a left side elevational view of the left deflector assembly of FIG. 7.

The presently preferred manner in which the outwardly biased maximum angle at which the deflector plate 126' is set is illustrated in FIG. 11. Thus, the inclination angle of the inside flat spacer 141' is chosen so as to correspond to the maximum inclination angle desired for the deflector plate 126'. When the adjacent inside surface portions of the deflector plate 126' are in approximate interfacial engagement with the adjacent surface portions of the flat spacer 141', the deflector plate 126' can no longer pivot outwards, as those skilled in the art will appreciate.

Figure 15:
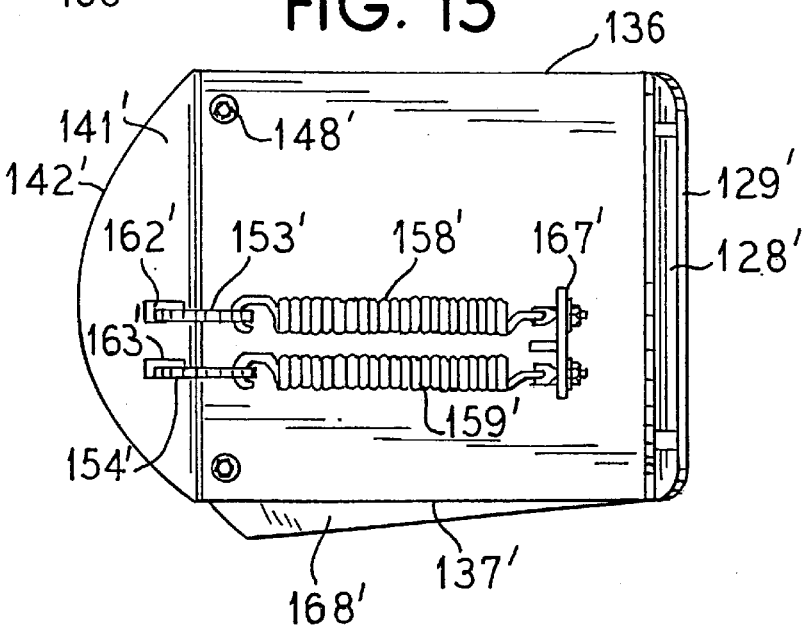
FIG. 15 is a back side elevational view of the base plate of the right (relative to the operator) deflector assembly of FIG. 7.

Preferably, the perimeter configuration of the deflector plate 126 or 126' corresponds approximately to the perimeter configuration of the flat region 134 or 134' respectively, but as shown in FIG. 15, the outside edge 129' of the deflector plate 126' more preferably extends beyond the outside side edge 139' of the flat region 134'.

Conveniently and preferably, parts for deflector subassembly 123 can interchangeably be used for deflector subassembly 122. For example, the deflector plate 126 can be inverted and used in deflector subassembly 122.

The foregoing description makes use of illustrative embodiments of this invention, and no limitations upon the present invention are to be implied or inferred therefrom.

What is claimed is:

1. In a snowplow of the type having an elongated, substantially straight blade having a smooth longitudinally and concavely curved forward face, opposite ends, a backface, and top and bottom edge portions, the improvement which comprises a snow deflector on said forward face adjacent to one of said opposite ends, said snow deflector comprising in combination:

(a) a base plate having a generally flattened medial region with opposed inner and outer opposite side portions and with means for mounting said base plate to said forward face so that a cavity is defined between said base plate and said forward face with said medial region extending generally laterally along and in adjacent relationship to said forward face;

(b) a generally flattened deflector plate having opposed inner and outer opposite side portions;

(c) hinge means interconnecting said deflector plate inner side portions with said base plate inner side portions for pivotal movement of said deflector plate towards and away from said medial region about a generally upright axis;

(d) generally arcuately extending arms having a proximal end portion and a distal end portion at opposite ends thereof, said proximal end portion being connected to said deflector plate and said arms extending backwards therefrom; and (e) biasing means located in said cavity and including an anchoring device connected to said base plate for biasing said deflector plate away from said medial region.

2. The snowplow of claim 1 wherein one said snow deflector is on said forward face adjacent to each one of said opposite ends.

3. The snowplow of claim 2 wherein said blade includes a blade extension at each said opposite end, and one said snow deflector is on the forward face of each of said blade extension.

4. The snowplow of claim 3 wherein hinge means pivotably connects each of said blade extension to said blade for moving each said blade extension from a blade extension extended position to a blade extension storage position relative to said blade.

5. In a snowplow of the type having an elongated, substantially straight blade having a smooth longitudinally and concavely curved forward face, opposite ends, a backface, and top and bottom edge portions, the improvement which comprises a snow deflector on said forward face adjacent to one of said opposite ends, said snow deflector comprising in combination:

(a) a base plate having:

(1) a generally flattened and continuously extending medial region having a quadrilateral perimeter with opposed top and bottom edge portions, opposed inner and outer opposite side portions and opposed front and rear surface portions, (2) inner and outer spacer members at said inner and outer opposite side portions, respectively, and extending backwards therefrom, each of said spacer members having a perimeter edge portion which generally extends in adjacent contiguous relationship to adjacent portions of said blade whereby a cavity is defined between said base plate and said forward face with said top and bottom edge portions extending generally laterally along and in adjacent relationship to said top and bottom edge portions respectively, and (3) mounting means for mounting said base plate to said blade;

(b) a deflector plate having:

(1) a generally flattened and continuously extending outer surface and a generally opposed inner surface with opposed top and bottom edge portions and opposed inner and outer opposite side portions, (2) hinge means interconnecting said deflector plate inner side portions with said base plate inner side portions for pivotal movement of said deflector plate towards and away from said medial region about a generally upright axis, and (3) generally arcuately extending arms having a proximal end portion and a distal end portion at opposite ends thereof said proximal end portion being connected to said deflector plate and said arms extending backwards therefrom and further passing through apertures defined in said inner spacer member; and (c) biasing means including connected anchoring device joined to said rear surface portions, said biasing means extending from said anchoring device to and being connected to said distal end portion for biasing said deflector plate away from said medial region.

6. The snowplow of claim 5, wherein one said snow deflector is on said forward face adjacent to each one of said opposite ends.

7. The snowplow of claim 6 wherein said blade includes a blade extension at each said opposite end, and one said snow deflector is on said forward face and on each of said blade extensions.

8. The snowplow of claim 7 wherein hinge means pivotably connects each of said blade extensions to said blade for moving each said blade extension from a blade extension extended position to a blade extension storage position relative to said blade.

9. A snow deflector for association with an end portion of a snowplow, said snow deflector comprising in combination:

(a) a base plate having a generally flattened medial region and including means for mounting said base plate on a concavely curved front portion of said snowplow adjacent an end thereof so that a cavity is defined between said medial region and said curved front portion;

(b) a generally flattened deflector plate;

(c) hinge means for connecting one end adjacent portion of said deflector plate to a side edge portion of said base plate;

(d) arcuate arms extending from said one end adjacent portion to said cavity; and (e) bias means, including mounting means, in said cavity and associated with said arms for positioning said deflector plate in an outward position.

* * * * *